US006379071B1

(12) United States Patent
Sorvino

(10) Patent No.: US 6,379,071 B1
(45) Date of Patent: Apr. 30, 2002

(54) SELF ALIGNING CONNECTOR BODIES

(75) Inventor: Alfred Sorvino, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/442,858

(22) Filed: Nov. 18, 1999

Related U.S. Application Data

(63) Continuation-in-part of application No. 09/054,430, filed on Apr. 3, 1998, now abandoned.

(51) Int. Cl.[7] ..... B25G 3/00

(52) U.S. Cl. ..... 403/13; 403/372; 403/225; 403/57

(58) Field of Search ..... 403/12, 13, 14, 403/372, 226, 225, 57, 74; 244/131

(56) References Cited

U.S. PATENT DOCUMENTS

| | | | | | |
|---|---|---|---|---|---|
| 3,505,739 | A | * | 4/1970 | Abrams | 256/250 |
| 3,806,064 | A | * | 4/1974 | Parilla | 244/131 X |
| 4,804,291 | A | * | 2/1989 | Everett | 403/287 |
| 4,805,298 | A | * | 2/1989 | Takahashi | 29/764 |
| 5,537,205 | A | * | 7/1996 | Cost et al. | 356/250 |
| 5,912,733 | A | * | 6/1999 | Dunlop et al. | 356/250 |

* cited by examiner

*Primary Examiner*—Lynne H. Browne
*Assistant Examiner*—John R. Cottingham
(74) *Attorney, Agent, or Firm*—David C. Collins; Colin M. Raufer; Glenn H. Lenzen, Jr.

(57) ABSTRACT

Self aligning, blind mating connector bodies are provided for connecting to mating connector bodies. One embodiment of the connector body has an annular housing with two slots disposed 180 degrees apart. An inner body has two dowel pins disposed at locations corresponding to the slots in the annular housing. A compliant O-ring is disposed between and is resiliently coupled to the inner body and the annular housing. The inner body is free to rotate relative to the annular housing about an axis defined by the dowel pins to provide single axis gimbal motion. Another embodiment of the connector body has an annular housing with two holes disposed 180 degrees apart. An inner body has two dowel pins disposed at locations corresponding to the holes in the annular housing. An external housing ring is connected to the annular housing using a second pair of dowel pins located 180 degrees apart that are disposed at 90 degrees with respect to the first set of dowel pins. In this embodiment, the inner body is free to rotate relative to the annular housing about an axis defined by the first pair of dowel pins, and the annular housing is free to rotate relative to the external housing ring about an axis defined by the second pair of dowel pins, thus providing two axis, dual gimbal motion that allows nutation. In both instances, a pair of openings is provided in the inner body to engage a mating pair of guide pins on the mating connector body.

11 Claims, 4 Drawing Sheets

SELF ALIGNING CONNECTOR BODIES

CROSS-REFERENCE TO RELATED APPLICATION

The present application is a continuation-in-part application of application Ser. No. 09/054,430, filed Apr. 3, 1998, now abandoned.

This invention was made with Government support under Contract No. N00019-97-C-0027 awarded by the Department of the Navy. The Government has certain rights in this invention.

BACKGROUND

The present invention relates generally to connector bodies, and more particularly, to self aligning, blind mating connector bodies.

Conventional connector bodies are generally not self-aligning. When using conventional connectors where blind installation is required, it is difficult or impossible to ensure that the alignment of the mating connectors is correct. This is particularly true where the size of the devices that are connected or their external geometry do not permit inspection.

Accordingly, it is an objective of the present invention to provide for self aligning, blind mating connector bodies that overcome the limitation of conventional connector bodies.

SUMMARY OF THE INVENTION

To accomplish the above and other objectives, the present invention provides for two self aligning, blind mating connector bodies. The connector bodies of the present invention eliminate the use of alignment rods, springs and other hardware required for alignment where a blind connection is required. The present invention implements the concept of a gimbal. The present invention uses one or more pair of dowel pins that permit axial movement of the connector and an annular platform for holding a compliant nonmetallic ring to provide float with respect to a mating device.

More specifically, a first embodiment of the connector body comprises an annular housing having two slots disposed 180 degrees apart with respect to each other. An inner body having two dowel pins is disposed at locations corresponding to the slots in the annular housing. A compliant O-ring is disposed between and is resiliently coupled to the inner body and the annular housing. In the first embodiment of the connector body, the inner body is thus free to rotate relative to the annular housing about an axis defined by the dowel pins to provide single axis gimbal motion.

A second embodiment of the present connector body comprises an annular housing having two holes in its periphery that are disposed substantially opposite to each other (approximately 180 degrees apart with respect to each other). An inner body having two dowel pins is disposed around its periphery at locations corresponding to the holes in the annular housing. An external housing ring is connected to the annular housing using a second pair of dowel pins disposed substantially opposite to each other (approximately 180 degrees apart with respect to each other) that are disposed orthogonal to (90 degrees with respect to) the first set of dowel pins. In the second embodiment of the connector body, the inner body is free to rotate relative to the annular housing about an axis defined by the first pair of dowel pins, and the annular housing is free to rotate relative to the external housing ring about an axis defined by the second pair of dowel pins, thus providing two axis, dual gimbal motion that allows nutation.

The present invention is a robust, economical self-aligning connector body that has a low profile contour and high reliability. The design of the present connector body is greatly simplified and may be manufactured with low cost. The present invention implements a unique technique for achieving the self-alignment properties needed in electrical connectors where blind installation makes it difficult or impossible to assure the alignment of the mating connectors. This is of particular importance where the size of the devices that are connected or their external geometry do not permit other methods of inspection.

The present self aligning connector bodies are particularly well-suited for use as mid-body connector for use in missiles or missile launchers, such as those manufactured by the assignee of the present invention. The present invention thus provides for improvements to connectors that require self-alignment and/or blind installation.

It should be noted that for such a device to work as designed, the mating half must have two stationary guide pins, which are a common feature in connectors.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
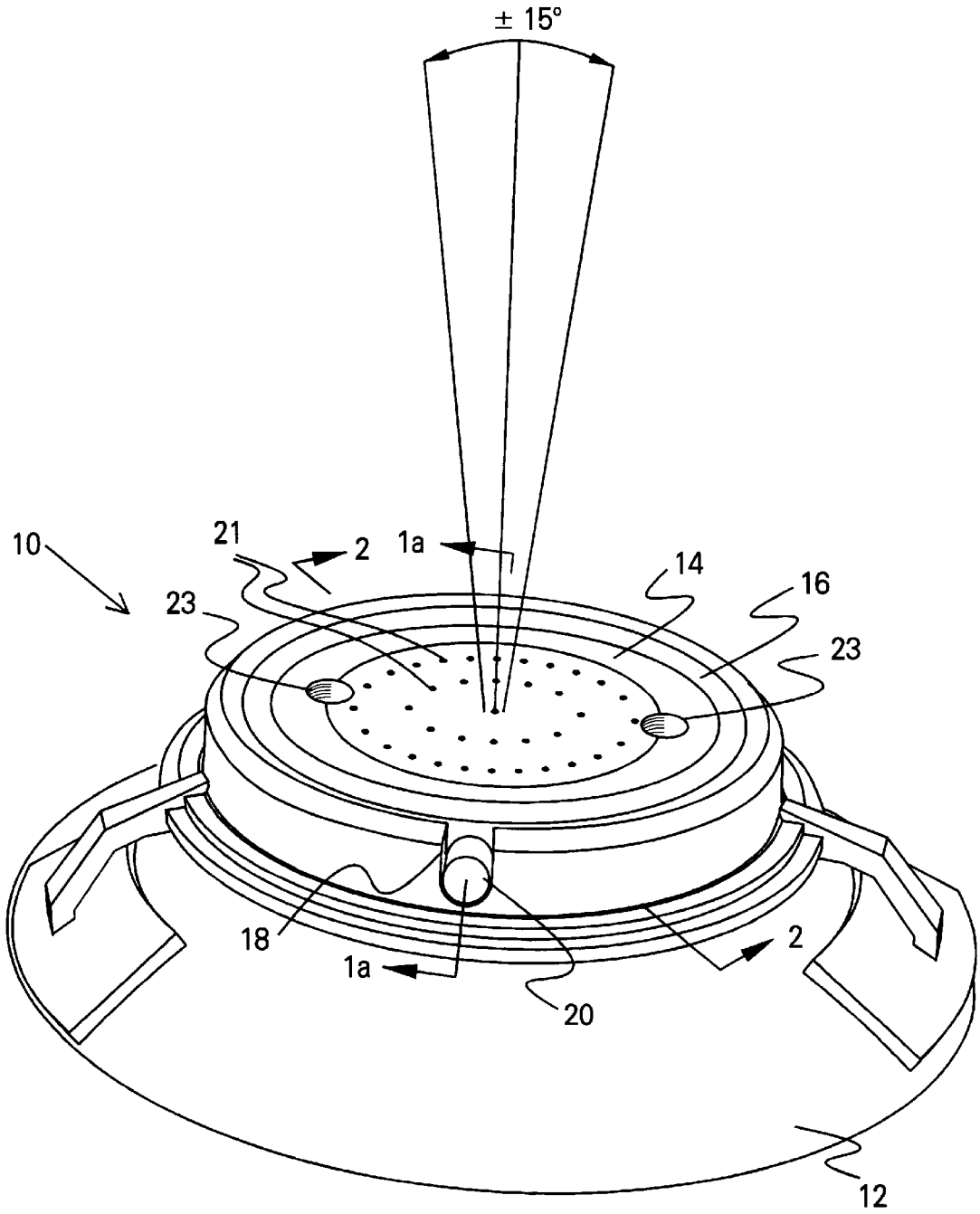
FIG. 1 illustrates a first embodiment of an exemplary self aligning connector body in accordance with the principles of the present invention.
Figure 1A:
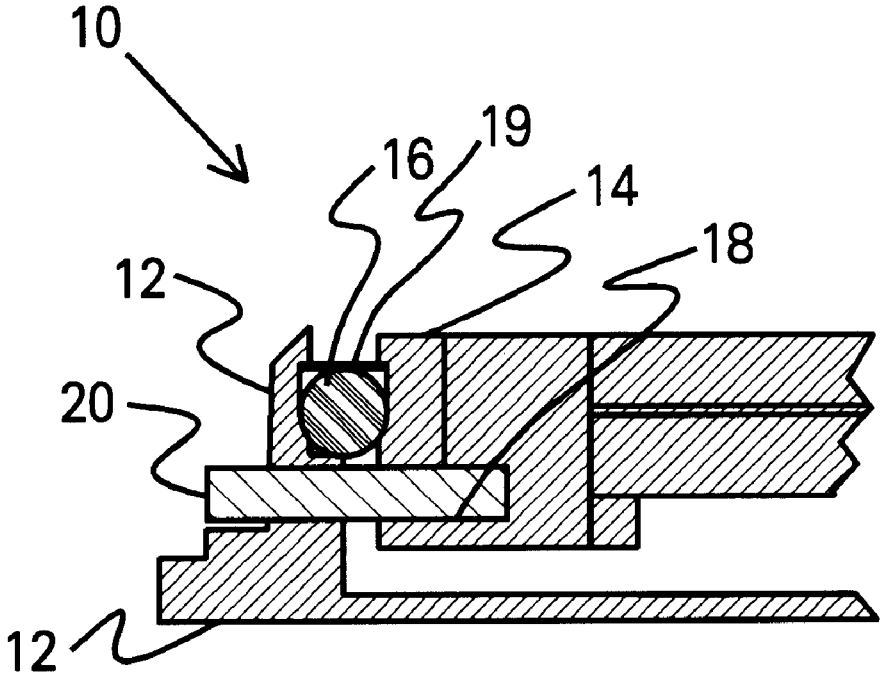
FIG. 1*a* is a partial vertical cross sectional view of the self aligning connector body shown in FIG. 1, taken along the lines 1*a*—1*a;*

Referring to the drawing figures, FIG. 1 illustrates a first embodiment of an exemplary self aligning connector body 10 in accordance with the principles of the present invention. FIG. 1*a* is a partial vertical cross sectional view of the self aligning connector body 10 shown in FIG. 1, taken along the lines 1*a*—1*a*. The first embodiment of the self aligning connector body provides for single axis gimbal motion.

The first embodiment of the self aligning connector body 10 illustrated in FIGS. 1 and 1*a* is comprised of an annular housing 12, an inner body 14, and a compliant O-ring 16 resiliently coupled between the annular housing 12 and the inner body 14. The annular housing 12 has two slots 18 in it placed 180 degrees apart. An outer shell of the inner body 14 has two stainless steel dowel pins 20 disposed in locations corresponding to the slots 18 in the annular housing 12. The dowel pins 20 are installed into the inner body 14 and it in turn is installed into the annular housing 12 along with the compliant O-ring 16.

A spring washer 19 may optionally be employed in conjunction with the O-ring 16. The spring washer 19 serves several functions, including keeping dirt out and retaining the O-ring 16 in position.

The first embodiment of the self aligning connector body 10 shown in FIG. 1 is illustrative of an AIM-9X mid-body umbilical connector used in an AIM-9X (Air Intercept Missile) missile manufactured by the assignee of the present invention. The design of the self aligning connector body 10 shown in FIG. 1 allows axial movement up to fifteen degrees in either direction from top dead center around the axis of the dowel pins 20.

As a part of this design, the compliant O-ring 16 is used between the annular housing 12 and the inner body 14. The compliant O-ring 16 may be an O-ring manufactured by Parker Seals, or other O-ring manufacturer, for example. The compliant O-ring 16 may be secured to the inner and outer peripheries of the annular housing 12 and inner body 14 using a sealant, such as an epoxy or other adhesive, for example. The compliant O-ring 16 acts as a spring to return the inner body 14 to its normal position. The compliant O-ring 16 also provides for environmental or EMI/RFI (electromagnetic interference/radio frequency interference) sealing.

Figure 2:
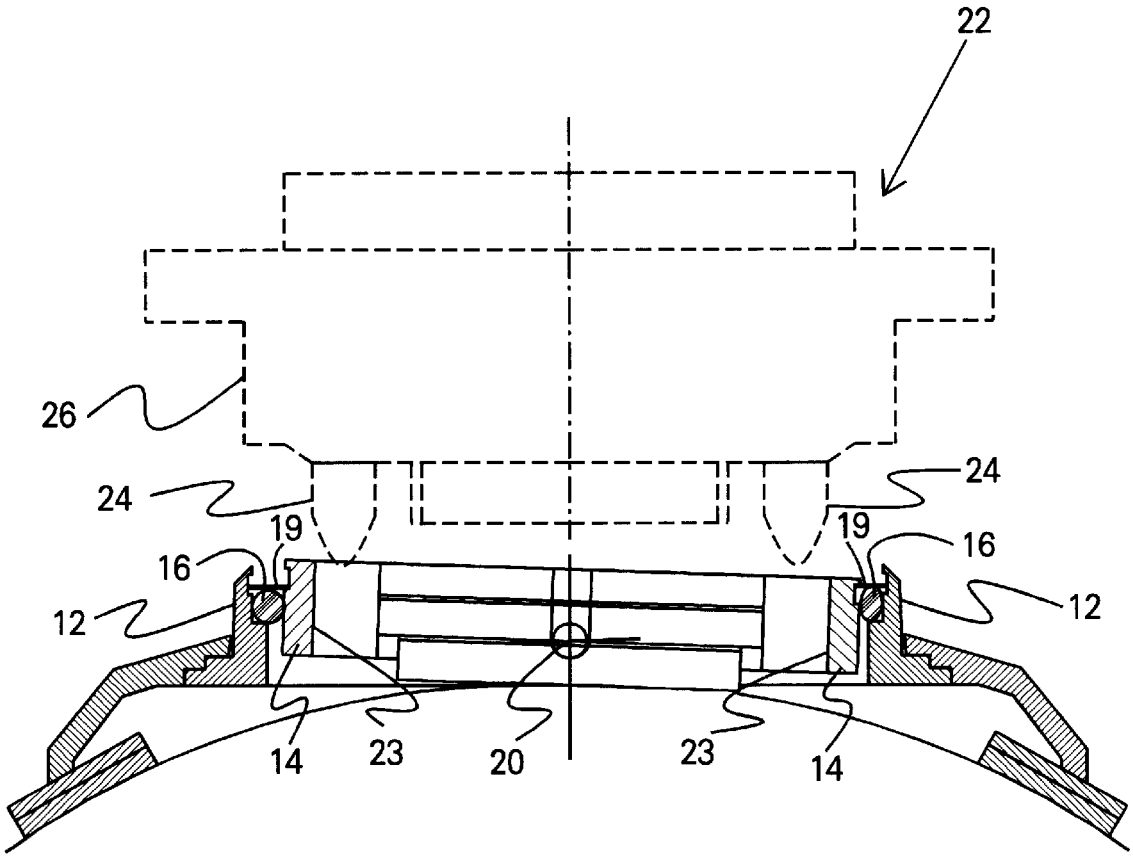
FIG. 2 is a cross-sectional view, taken along the lines 2—2, illustrating both halves of a connector and the guide pins moving into place and allowing the first embodiment (FIG. 1) to align itself.

The self aligning connector body of FIG. 1 also includes a plurality of connector openings 21 for receiving a plurality of corresponding connector pins 22 (shown in FIG. 2). The self aligning connector body further includes a pair of holes 23 in the top surface of the inner body 14. As shown in FIG. 2, the pair of holes 23 receive a corresponding pair of guide pins 24 (shown in phantom) secured to a mating connector body 26 (also shown in phantom).

Figure 3:
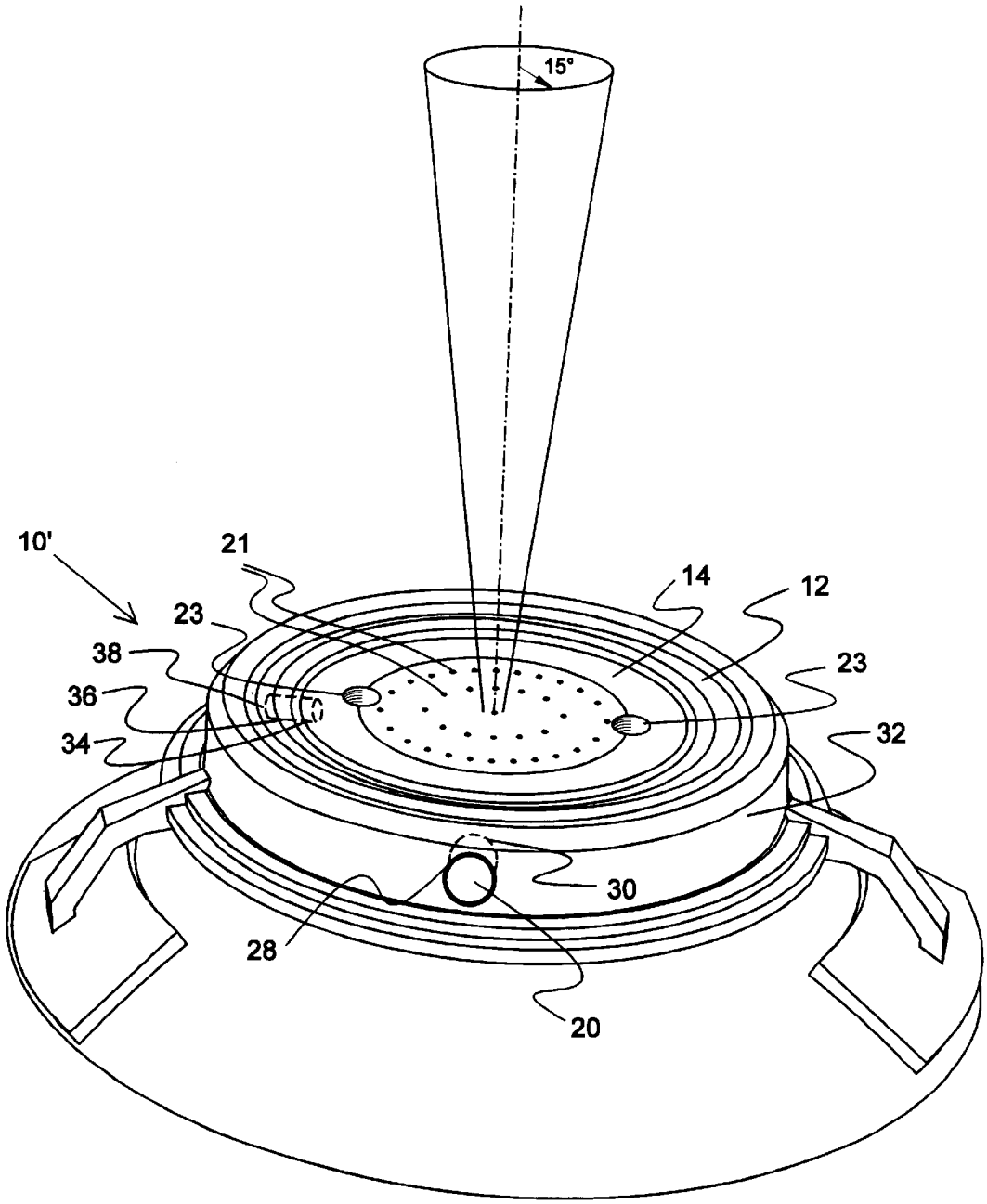
FIG. 3 illustrates a second embodiment of an exemplary self aligning connector body in accordance with the principles of the present invention.

FIG. 3 illustrates a second embodiment of an exemplary self aligning connector body 10' in accordance with the principles of the present invention. The second embodiment of the self aligning connector body 10' provides two axis, dual gimbal motion that allows nutation.

The second embodiment of an exemplary self aligning connector body 10' is comprised of an annular housing 12 and an inner body 14. The annular housing 12 has two holes 28 in it disposed 180 degrees apart. The first pair of stainless steel dowel pins 20 are disposed in the two holes 28 of the annular housing 12 and in two holes 30 in the inner body 14. Thus, the first pair of stainless steel dowel pins 20 are disposed 180 degrees with respect to each other and interconnect the annular housing 12 and inner body 14. The annular housing 12 and inner body 14 are thus free to rotate with respect to each other around an axis defined by the first pair of stainless steel dowel pins 20.

In addition, an external housing ring 32 is provided. The external housing ring 32 is connected to the annular housing 12 by means of a second pair of stainless steel dowel pins 34 that are disposed at 90 degrees with respect to the first set of dowel pins 20. The second pair of stainless steel dowel pins 34 are disposed in adjacent holes 36, 38 in the annular housing 12 and the external housing ring 32, respectively.

The second embodiment of the self aligning connector body 10' shown in FIG. 3 is illustrative of an AIM-9X mid-body umbilical connector used in an AIM-9X missile manufactured by the assignee of the present invention that has been modified to have the multi-axial gimbal design of the present invention. The guide pins of the mating connector (not shown) engage in the pair of holes 22 on the top surface of the inner body 14, as depicted in FIG. 2.

The second embodiment of the self aligning connector body 10' thus has three basic components and two pairs of dowel pins 20, 34. The design of the connector body 10' shown in FIG. 3 achieves fifteen degrees of motion in a conical section, thus providing for nutating motion.

A prototype embodiment of the present connector body 10 has been tested using an AIM-9X missile launcher. The prototype connector body 10 has been installed and removed from the AIM-9X missile launcher with good success. The connector body 10 engaged and disengaged as anticipated and performed all other requirements without any problems.

The cost to manufacture either of the two connector bodies 10, 10' is expected to be substantially less than the manufacturing cost of the existing AIM-9X or AMRAAM (Advanced Medium Range Air-Air Missile) launcher connectors. The cost savings is expected to be on the order of 50 percent of the cost of the AMRAAM launcher connector body 10.

Both the AIM-9X or AMRAAM launcher connectors have identical pin arrangements, the pin count and have identical connector insulators. Thus, the established configuration of the AIM-9X or AMRAAM launcher connectors are not compromised when using either of the present connector bodies 10, 10'. A comparative review of the design of the AMRAAM mid-body connector and that of the AIM-9X mid-body connector shows that they have identical mating dimensions, maximum diameter, height and other external features. The chief difference between the AIM-9X or AMRAAM launcher connectors is that the AMRAAM connector body is more complex and has a high part count. Both the AIM-9X or AMRAAM launcher connectors function identically, and the present connector bodies 10, 10' may be used with either of them without compromise of the launcher.

While the self-aligning connector body 10, 10' has been described in conjunction with missile launcher connectors, the connector body of the present invention may also find use in any situation requiring connection of a stable first connector 10, 10' to a potentially out-of-position second connector 26. Examples include coupling of railroad cars and docking of a space vehicle to a space station.

Thus, improved self aligning, blind mating connector bodies have been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A first self aligning electrical connector body for connecting to a second electrical connector body including a pair of mating guide pins, the first self aligning electrical connector body comprising:

an annular housing having two slots disposed substantially opposite with respect to each other;

an inner body having two dowel pins disposed at locations corresponding to the slots in the annular housing;

a pair of holes for receiving the pair of mating guide pins from the second electrical connector body; and a compliant O-ring resiliently disposed between the inner body and the annular housing; and wherein the inner body is free to rotate relative to the annular housing about an axis defined by the dowel pins to provide single axis gimbal motion.

2. The connector body of claim 1 wherein the two dowel pins comprise stainless steel.

3. The connector body of claim 1 wherein the relative motion between the inner body and the annular housing is about fifteen degrees in either direction from top dead center around an axis defined by the dowel pins.

4. The connector body of claim 1 wherein the compliant O-ring acts as a spring to return the inner body to its top dead center position.

5. The connector body of claim 1 wherein the compliant O-ring also provides for environmental and EMI/RFI sealing.

6. The connector body of claim 1 further including a spring washer for retaining said compliant O-ring in position.

7. A first self aligning connector body for connecting to a second connector body including a pair of mating guide pins, the first self aligning connector body comprising:

an annular housing having two slots disposed substantially opposite with respect to each other;

an inner body having two dowel pins disposed at locations corresponding to the slots in the annular housing;

a pair of holes for receiving the pair of mating guide pins from the second connector body;

a compliant O-ring resiliently disposed between the inner body and the annular housing; and a spring washer for retaining said compliant O-ring in position; and wherein the inner body is free to rotate relative to the annular housing about an axis defined by the dowel pins to provide single axis gimbal motion.

8. The connector body of claim 7 wherein the two dowel pins comprise stainless steel.

9. The connector body of claim 7 wherein the relative motion between the inner body and the annular housing is about fifteen degrees in either direction from top dead center around an axis defined by the dowel pins.

10. The connector body of claim 1 wherein the compliant O-ring acts as a spring to return the inner body to its top dead center position.

11. The connector body of claim 1 wherein the compliant O-ring also provides for environmental and EMI/RFI sealing.

* * * * *